US012708165B2

(12) United States Patent
Wong

(10) Patent No.: US 12,708,165 B2
(45) Date of Patent: Aug. 18, 2026

(54) BASEBALL CAP WITH DETACHABLE POUCH

(71) Applicant: Franklin Wong, Phoenix, AZ (US)

(72) Inventor: Franklin Wong, Phoenix, AZ (US)

( * ) Notice: Subject to any disclaimer, the term of this patent is extended or adjusted under 35 U.S.C. 154(b) by 18 days.

(21) Appl. No.: 19/079,582

(22) Filed: Mar. 14, 2025

(65) Prior Publication Data

US 2025/0366556 A1 Dec. 4, 2025

Related U.S. Application Data

(60) Provisional application No. 63/654,734, filed on May 31, 2024.

(51) Int. Cl.
*A42B 1/241* (2021.01)

(52) U.S. Cl.
CPC ..... *A42B 1/241* (2013.01)

(58) Field of Classification Search
CPC ..... A42B 1/24; A42B 1/241; A42B 1/0187; A45F 5/02; A45F 2005/023
See application file for complete search history.

(56) References Cited

U.S. PATENT DOCUMENTS 2,055,560 A * 9/1936 Rose ..... A42B 1/0187 2/172
2,154,059 A * 4/1939 Alexander ..... A42B 1/006 D2/866
3,610,622 A * 10/1971 Haroski ..... A63B 67/10 446/28
4,151,938 A * 5/1979 Barker ..... A45F 5/02 224/183
RE30,899 E * 4/1982 Kallman ..... A45F 5/02 24/3.3
4,425,917 A * 1/1984 Kuznetz ..... F25D 3/08 607/110
4,632,389 A * 12/1986 Moss ..... A42B 1/24 273/DIG. 30
4,911,432 A * 3/1990 Walden ..... A63B 69/0086 482/148
4,988,093 A * 1/1991 Forrest, Sr. ..... A63B 23/025 2/909
5,081,717 A * 1/1992 Shedd ..... A42B 1/0187 2/181.4
5,153,943 A * 10/1992 Clement ..... A42B 1/0187 2/418
5,212,837 A * 5/1993 Gose ..... A42B 3/105 2/916
5,493,734 A * 2/1996 Nieves-Rivera ..... A42B 3/105 2/48
5,581,815 A * 12/1996 Hans ..... A41D 13/0015 2/244
5,623,732 A * 4/1997 Olajide, Jr. ..... A42B 1/0187 2/202
5,666,668 A * 9/1997 Ronquillo ..... A42B 1/06 2/172

(Continued)

*Primary Examiner* — Heather Mangine
(74) *Attorney, Agent, or Firm* — Bruce A. Lev

(57) ABSTRACT

A baseball cap with a pouch releasably attached to and extending downwardly from a backside thereof and is adapted to releasably hold items therein and is also adapted to stabilize and retain the cap upon a user's head during user movements and when exposed to environmental forces, such as wind and rain.

2 Claims, 3 Drawing Sheets

(56) References Cited

U.S. PATENT DOCUMENTS 5,860,165 A * 1/1999 Cvijanovich ..... A42B 1/0186 2/172
5,933,871 A * 8/1999 Kraft ..... A42B 1/24 2/209.13
5,996,124 A * 12/1999 Asp, Jr. ..... A42B 1/241 2/172
6,061,837 A * 5/2000 Oh ..... A63B 60/40 2/209.12
6,170,087 B1 * 1/2001 Brannon ..... G09F 21/02 2/209.13
6,230,331 B1 * 5/2001 Aguilar ..... A45C 9/00 2/171.1
6,317,892 B1 * 11/2001 Galigani ..... A42B 1/241 2/209.12
6,857,134 B1 * 2/2005 Cowell ..... A42C 5/04 2/209.13
6,877,168 B1 * 4/2005 Duffy ..... A42B 7/00 132/57.1
7,487,554 B1 * 2/2009 Epstein ..... A42B 1/24 2/171.2
D617,537 S * 6/2010 Pearson ..... D2/884
8,209,781 B2 * 7/2012 Krochmal ..... A42B 3/16 2/8.1
D666,366 S * 8/2012 Votel ..... D29/122
8,295,533 B1 * 10/2012 Schachtman ..... A45F 5/00 381/385
8,595,867 B1 * 12/2013 Zinna ..... A45F 5/021 2/244
D707,018 S * 6/2014 Hart ..... D2/882
D835,890 S * 12/2018 Swank ..... D2/891
10,349,694 B1 * 7/2019 Calvert Rowton ..... G02C 3/02
10,952,482 B2 * 3/2021 Plon ..... A42B 1/24
11,206,879 B2 * 12/2021 Peterson ..... A42B 3/105
12,114,720 B2 * 10/2024 Berger ..... A45C 13/08
2004/0079843 A1 * 4/2004 Medwed ..... A61J 9/0661 248/104
2004/0139530 A1 * 7/2004 Yan ..... A42B 1/241 2/209.13
2005/0279786 A1 * 12/2005 Gac ..... A45F 5/02 224/181
2006/0048279 A1 * 3/2006 Bartos ..... A42B 1/24 2/209
2007/0000026 A1 * 1/2007 Carr ..... A42B 1/0187 2/184.5
2007/0220717 A1 * 9/2007 Brinson ..... A45F 5/02 24/298
2007/0245458 A1 * 10/2007 McGee ..... A42B 1/06 2/195.3
2008/0066214 A1 * 3/2008 O'Hare ..... A42B 1/241 2/243.1
2009/0013449 A1 * 1/2009 Kahn ..... A42B 1/24 24/3.1
2010/0031409 A1 * 2/2010 Norris ..... A42B 3/105 2/2.5
2010/0281600 A1 * 11/2010 Tagg ..... A42B 1/24 2/171
2011/0302697 A1 * 12/2011 Jaquez ..... A42B 1/08 2/209.12
2013/0025019 A1 * 1/2013 Jones ..... A45F 5/02 2/69
2014/0005722 A1 * 1/2014 Whelan ..... A61J 17/111 112/475.01
2014/0157472 A1 * 6/2014 Crye ..... A42B 3/085 2/2.5
2014/0163607 A1 * 6/2014 Tominaga ..... A42B 1/24 606/204.15
2014/0230129 A1 * 8/2014 Viviani ..... A42B 1/24 2/209.13
2014/0310853 A1 * 10/2014 Miles ..... A42B 1/0187 2/172
2015/0059054 A1 * 3/2015 Peterson ..... A42B 1/0187 2/172
2015/0224033 A1 * 8/2015 Moylan ..... A45F 5/02 24/3.13
2016/0029728 A1 * 2/2016 Byrd ..... A42B 1/24 224/181
2016/0128411 A1 * 5/2016 Ayres ..... A42B 1/008 2/172
2016/0374407 A1 * 12/2016 Yagerman ..... A45F 5/02 2/102
2017/0238641 A1 * 8/2017 Chapman ..... A42B 7/00
2017/0245573 A1 * 8/2017 Diliberto ..... A42B 1/0186
2017/0318886 A1 * 11/2017 Quiroz ..... A42B 1/02
2018/0055127 A1 * 3/2018 Plon ..... A42B 1/006
2018/0104142 A1 * 4/2018 Assaly ..... A63B 71/10
2018/0368602 A1 * 12/2018 Albanese ..... F16B 45/023
2019/0030394 A1 * 1/2019 Orr ..... G16H 20/30
2019/0045864 A1 * 2/2019 Teat ..... A42B 1/225
2019/0059566 A1 * 2/2019 Gaudyn ..... A45F 5/02
2019/0104853 A1 * 4/2019 Fan ..... A42B 1/006
2019/0289945 A1 * 9/2019 Tchakerian ..... A42B 1/02
2019/0297982 A1 * 10/2019 Denny ..... A42B 1/004
2019/0313778 A1 * 10/2019 Beckage ..... A45C 13/1069
2020/0054089 A1 * 2/2020 Gong ..... A42B 1/006
2020/0107602 A1 * 4/2020 Domenighini ..... A41F 1/00
2020/0268135 A1 * 8/2020 Ollinger ..... A45F 5/06
2020/0329800 A1 * 10/2020 Choi ..... A42B 1/045
2021/0093032 A1 * 4/2021 Pakula, Jr. ..... A42B 1/18
2021/0368951 A1 * 12/2021 Monge ..... A45F 5/021
2021/0378341 A1 * 12/2021 Cronk ..... A42B 1/245
2022/0007759 A1 * 1/2022 Powell ..... A42B 1/018
2022/0047027 A1 * 2/2022 Marquez Diaz ..... A42B 1/241
2022/0053864 A1 * 2/2022 Kim ..... A41D 13/1161
2022/0142288 A1 * 5/2022 Kim ..... A42C 5/02
2022/0151315 A1 * 5/2022 Hugenberg ..... A42B 1/241
2022/0256957 A1 * 8/2022 Nakamura ..... A42B 1/0187
2023/0284725 A1 * 9/2023 Lewis ..... A42B 1/225
2024/0032635 A1 * 2/2024 Kim ..... A62B 18/084
2025/0072543 A1 * 3/2025 Ngo ..... A42B 1/247
2025/0072587 A1 * 3/2025 Nebres ..... A45F 3/16
2025/0089831 A1 * 3/2025 Ahrweiler ..... A42B 1/24
2025/0089834 A1 * 3/2025 Maiden ..... A42B 1/24
2025/0234949 A1 * 7/2025 Crowe ..... A42B 1/247

* cited by examiner

BASEBALL CAP WITH DETACHABLE POUCH

CROSS-REFERENCE TO RELATED APPLICATION

The present application is related to and claims priority from prior provisional application Ser. No. 63/654,734, filed May 31, 2024 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71 (d).

BACKGROUND OF THE INVENTION

1. Field of the Invention

This invention relates generally to hats and caps, specifically to baseball caps including pockets or pouches.

2. Description of the Related Art

Prior art hats and caps have side pockets on the cap or a secret pocket under the cap in its liner or sweat band. However, none of them hang downwardly from a back portion of the cap nor are detachable. Some prior art hats and caps do have removable neck cover flaps hanging downwardly from a back portion of the cap but are not designed to retain items thereon or therein nor provide any stability to a hat upon a person's head. Accordingly, the present invention overcomes these disadvantages associated with the prior art.

BRIEF SUMMARY OF THE INVENTION

In view of the foregoing disadvantages inherent in the known types of hats and caps or the like in the prior art, the present invention provides a baseball cap with a detachable pouch that includes an elongated releasable connecting means between the backside of the hat and the pouch and is adapted to releasably hold items therein and also stabilize the cap upon a user's head during user movement and when exposed to environmental forces, with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
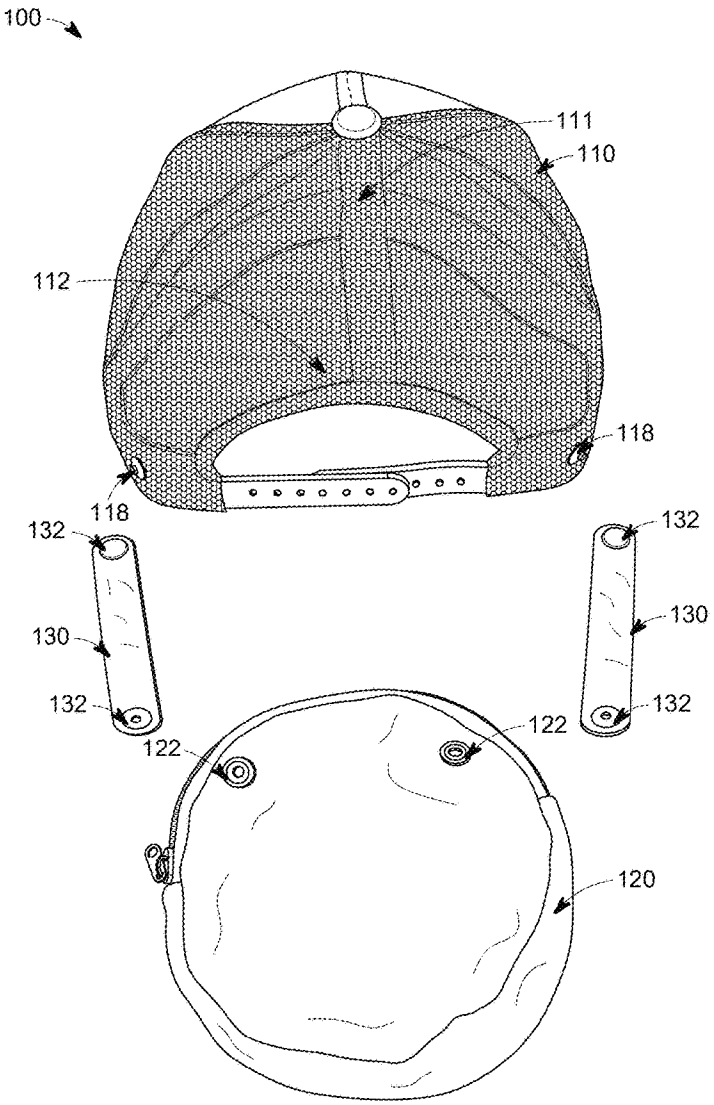
FIG. 1 shows a back view of the baseball cap with a detachable pouch detached therefrom according to the preferred embodiment of the present invention.
Figure 2:
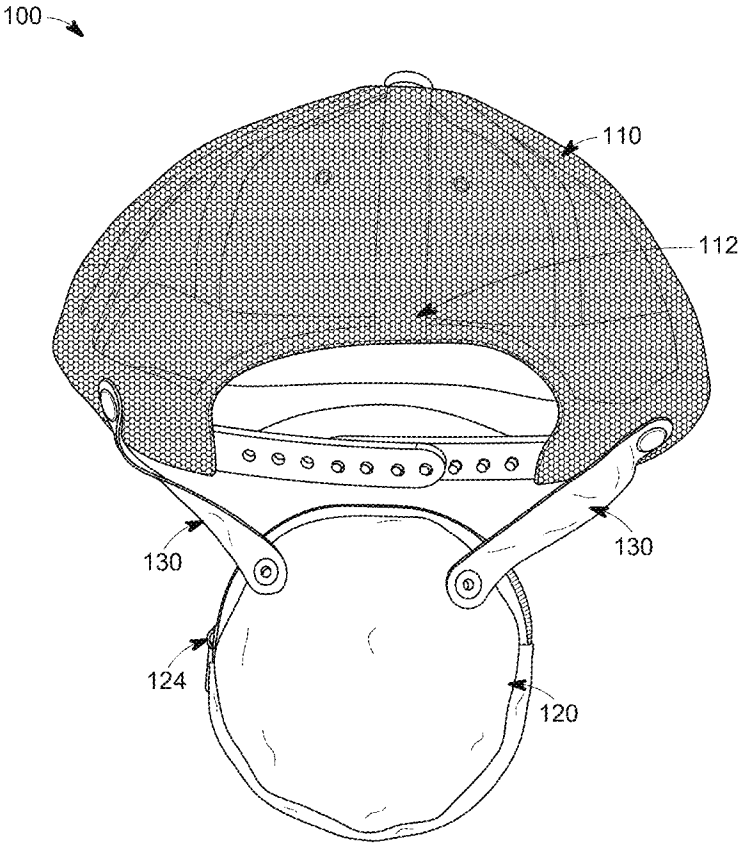
FIG. 2 shows a back view of the baseball cap with a detachable pouch attached thereto according to the preferred embodiment of the present invention of FIG. 1.
Figure 3:
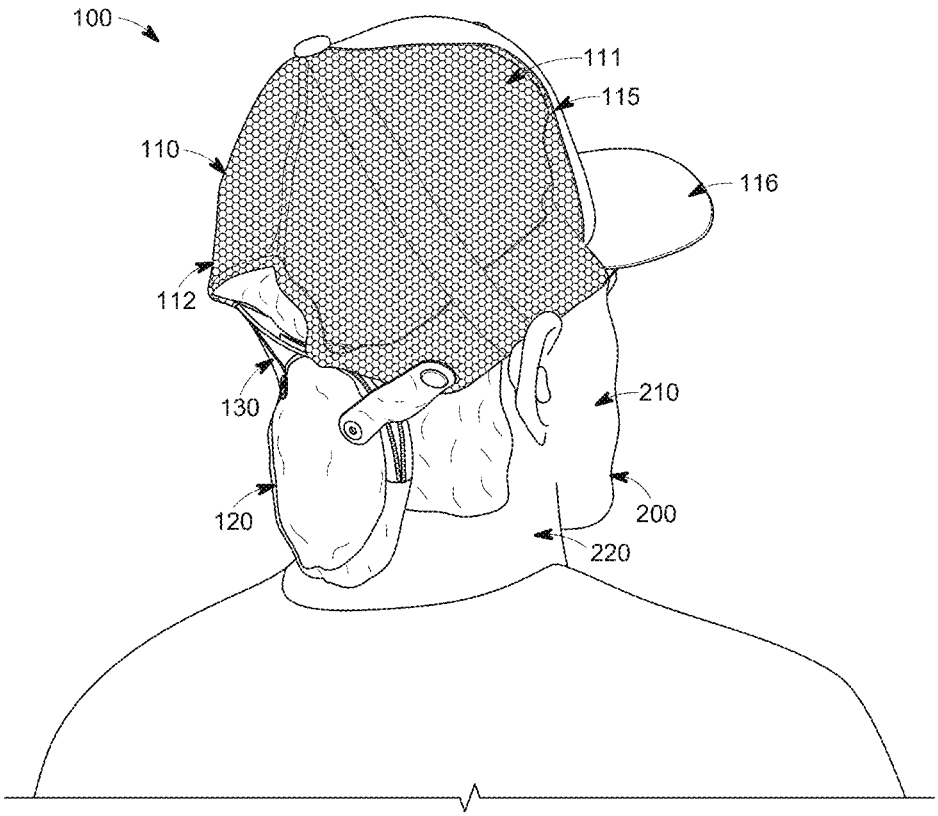
FIG. 3 shows a back perspective view of the baseball cap with a detachable pouch attached thereto and upon the head of a user according to the preferred embodiment of the present invention of FIG. 1.

Turning now descriptively to drawing, referring to FIGS. 1-3, the present invention discloses a baseball cap with a detachable pouch, 100, comprising a baseball cap 110 with a detachable pouch 120. The baseball cap 110 comprises a crown portion 111 including a back portion 112 having a left side and a right side, a front portion 115, a first connector member 118 attached to the left side of the back portion 112, and a second connector member 118 attached to the right side of the back portion 112, wherein the crown portion 111 is adapted to be place upon a person's head 210, and a visor 116 attached to and extending from the front portion 115 of the crown portion 111; a pouch 120 including an outer surface, an interior volume, a first connector member 122 attached to a left side of the outer surface, and a second connector member 122 attached to a right side of the outer surface; and a pair of detachable connector members 130, each including an elongated body having a proximal end, and a distal end, a first connector member 132 attached to the proximal end of the elongated body and is adapted to releasably connect with one of the first and second connector members 118 of the crown portion 111, and a second connector member 132 attached to the distal end of the elongated body and is adapted to releasably connect with one of the first and second connector members 122 of the pouch 120.

When in use, the pouch 120 is connected to the back portion 112 of the crown portion of the baseball cap via the pair of detachable connector members 130, such that when the baseball cap is placed upon the person's head 210 the pouch 120 hangs downwardly from the baseball cap 110 and adjacent the neck 220 of the person 200, and adapted to releasably hold items therein and stabilize the cap upon the person's head 210 during the person's body movement and when exposed to environmental forces.

In the preferred embodiment, the pouch 120 further includes a zipper 124 adapted to open and enclose the interior of the pouch. Furthermore, the first and second connector members 118 of the crown portion 111 of the baseball cap are formed as snap connectors, wherein the first and second connector members 122 of said pouch 120 are formed as a snap connectors, and wherein the first and second connector members 132 of said pair of detachable connector members 130 are formed as snap connectors, such that the pair of detachable connector members 130 can releasably attach the pouch to the baseball cap via the snap connectors.

In the preferred embodiment, the pouch 120 provides storage capacity for items such as keys, identification, lip balm, and other personal affects, while also providing stability to the baseball cap via its weight and position along the backside of the neck 220 of a person 200. As such, during windy conditions or during the movement of a person's head, the baseball cap will tend to remain on the person's head 210.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A baseball cap with a detachable pouch, comprising:
said baseball cap including:
a crown portion including:
a back portion including:
a left side; and
a right side;
a front portion;
a first connector member;
wherein said first connector member is attached to said left side of said back portion; and
a second connector member;
wherein said second connector member is attached to said right side of said back portion;
wherein said crown portion is adapted to be place upon a person's head; and
a visor:
wherein said visor is attached to and extends from said front portion of said crown portion;
said pouch including:
an outer surface;
an interior volume;
a first connector member;
wherein said first connector member is attached to a left side of said outer surface; and
a second connector member;
wherein said second connector member is attached to a right side of said outer surface; and
a pair of detachable connector members, each detachable connector member of the pair of detachable connector members including:
an elongated body having:
a proximal end; and
a distal end;
a first connector member;
wherein said first connector member is attached to said proximal end of said elongated body and is adapted to releasably connect with one of said first and second connector members of said crown portion; and
a second connector member;
wherein said second connector member is attached to said distal end of said elongated body and is adapted to releasably connect with one of said first and second connector members of said pouch;
wherein when in use, said pouch is connected to said back portion of said crown portion of said baseball cap via said pair of detachable connector members, such that when said baseball cap is placed upon said person's head said pouch hangs downwardly from said baseball cap and adjacent a neck of said person, and adapted to releasably hold items therein and stabilize the cap upon said person's head during said person's body movement and when exposed to environmental forces.

2. The baseball cap with a detachable pouch of claim 1, wherein said pouch further includes a zipper adapted to open and enclose said interior volume of said pouch.

* * * * *